United States Patent [19]

Borneman

[11] 4,186,662

[45] Feb. 5, 1980

[54] DUPLEXING COPYING SYSTEM

[75] Inventor: Lawrence Borneman, Lombard, Ill.

[73] Assignee: A. B. Dick Company, Chicago, Ill.

[21] Appl. No.: 826,847

[22] Filed: Aug. 22, 1977

[51] Int. Cl.[2] ..... B41F 5/02; B41F 13/28; B41F 21/04; B41F 21/08

[52] U.S. Cl. ..... 101/218; 101/230; 101/231; 101/234; 101/426; 271/225; 271/DIG. 9; 355/24

[58] Field of Search ..... 101/230, 229, 231, 232, 101/177, 217, 174, 175, 218, 136, 137, 140, 141, 142, 144, 247, 233, 234, 426; 271/184–186, 277, 225, 65, 69, 82, DIG. 9; 355/23, 24

[56] References Cited

U.S. PATENT DOCUMENTS

| | | | |
|---|---|---|---|
| 214,065 | 4/1879 | Tucker | 101/230 X |
| 252,153 | 1/1882 | Stonemetz | 101/230 |
| 272,834 | 2/1883 | Hawkins | 101/230 |
| 272,835 | 2/1883 | Hawkins | 101/230 |
| 367,024 | 7/1887 | Clark et al. | 101/174 |
| 517,907 | 4/1894 | Wendte | 101/174 |
| 936,151 | 10/1909 | North | 271/277 |
| 939,553 | 11/1909 | Scheuerer | 101/177 |
| 958,484 | 5/1910 | Evans et al. | 101/13 D X |
| 2,412,132 | 12/1946 | Dell | 101/232 |
| 2,625,101 | 1/1953 | Gammeter | 101/230 |
| 2,723,119 | 11/1955 | Engebretson | 101/231 |
| 2,765,735 | 10/1956 | Daly et al. | 101/91 |
| 3,012,500 | 12/1961 | Koch | 101/230 |
| 3,431,844 | 3/1969 | Ogden | 101/234 |
| 3,557,391 | 11/1970 | Mowry | 101/230 X |
| 3,581,866 | 6/1971 | Hottendorf | 101/230 X |
| 3,654,861 | 4/1972 | Rudolph et al. | 101/183 |
| 3,672,765 | 6/1972 | Altmann | 355/23 |
| 3,690,253 | 9/1972 | Dreyer | 101/217 |
| 3,742,847 | 7/1973 | Zimmermann et al. | 101/230 |
| 3,769,910 | 11/1973 | Heimlicher | 101/177 |
| 3,772,990 | 11/1973 | Weisgerber | 101/230 |
| 3,796,154 | 3/1974 | Weisgerber | 101/232 |

FOREIGN PATENT DOCUMENTS

| | | | |
|---|---|---|---|
| 1213427 | 3/1966 | Fed. Rep. of Germany | 101/174 |
| 2633183 | 2/1977 | Fed. Rep. of Germany | 101/230 |
| 104343 | 8/1917 | United Kingdom | 101/230 |
| 148513 | 7/1920 | United Kingdom | 101/230 |
| 1368496 | 9/1974 | United Kingdom | 101/217 |
| 1481237 | 7/1977 | United Kingdom | 101/230 |

*Primary Examiner*—J. Reed Fisher

*Attorney, Agent, or Firm*—McDougall, Hersh & Scott

[57] ABSTRACT

A system for duplicating images wherein a copy sheet is delivered to an impression cylinder. A first image is transferred to one side of each sheet. Each sheet is then removed from the impression cylinder, delivered to a reversing means and then to the impression cylinder, trailing edge first. The re-feeding is in synchronism with the second image whereby this second image is transferred to the opposite side of each sheet. The impression cylinder is provided with a first gripper for engaging the leading edge of each sheet when the sheet is first fed to the impression cylinder. A second gripper is provided on the impression cylinder for engaging the trailing edge of each sheet. The impression cylinder thus simultaneously carries the sheets as the sheets are moved through the stages of operation.

14 Claims, 10 Drawing Figures

DUPLEXING COPYING SYSTEM

BACKGROUND OF THE INVENTION

This invention relates to a system for the production of duplicate copies of images. The invention is particularly concerned with duplicators of the type wherein copy sheets are supported on a cylinder and transferred to the sheets.

Highly satisfactory duplicating equipment is available for the production of copies with images formed on one side of the copy sheets. Such equipment can be reliably operated at highly satisfactory production rates.

Since copy sheet material of the type conventionally employed can readily accept images on both sides, it would be highly desirable to provide equipment suitable for transferring images to both sides of a copy sheet. This will provide clear savings in the amount of paper employed, additional savings in the amount of space occupied by the copies produced, savings in production time, and savings in cost of equipment.

Attempts have been made to produce copy sheets imaged on both sides (hereinafter referred to as "duplexing"). The use of separate presses located in tandem has been proposed, and although this represents a workable system, it is more costly due to the duplication of equipment involved. Paper handling considerations have also resulted in lower press speeds.

Perfector presses have also been employed for duplexing. Such presses utilize double master cylinders, blanket cylinders, ink systems, and dampening systems. More highly skilled operators and equipment expense make such presses undesirable.

Other proposals include the use of a large combination master and impression cylinder associated with a half-size blanket cylinder. In such an arrangement, the master cylinder places a first-side image onto the blanket cylinder whereby images are placed upon the sheets from the blanket cylinder and also from the impression section of the larger cylinder which includes a letter press or direct lithoplate. This system involves a lower production rate than other systems described.

Duplexing in copiers is accomplished by printing a desired number of first side sheets, storing the sheets, and then re-feeding them for receipt of a second side image. Reference is also made to Altmann U.S. Pat. No. 3,672,765 which discloses "on line" duplexing in photoconductive equipment.

Stonemetz Pat. No. 252,153 teaches a system for duplexing copies wherein a sheet is introduced between an impression cylinder and a type cylinder. In this system, the type cylinder carries two forms for transferring separate images, and a "blank" area is defined between the forms. The type cylinder makes one revolution while the smaller impression cylinder makes three revolutions. The copy sheet is printed on one side during a first revolution of the impression cylinder and discharged from the equipment. The impression cylinder makes an additional revolution while the "blank" area of the type cylinder passes, and the copy sheet is then re-fed, trailing edge first, for formation of the other image on the other side of the copy sheet during the third revolution of the impression cylinder.

SUMMARY OF THE INVENTION

The present invention involves a system for duplexing wherein high production rates can be achieved without excessive expenditures in terms of additional operating mechanisms. For purposes of illustrating the invention, the following description will specifically refer to systems wherein ink images are repeatedly formed on a blanket cylinder or the like. Copy sheets are introduced between the blanket cylinder and an adjacent impression cylinder for transfer of the ink images to the copy sheet. As will be more fully explained, however, applications beyond offset duplicators are contemplated.

The invention is particularly adaptable to the duplexing of copy sheets in offset equipment wherein the master cylinders, blanket cylinders and impression cylinders of the equipment are of conventional size. Moreover, the copy sheets to be duplexed are fed to the equipment at high rates of speed so that duplex copies can be obtained at rates comparable to customary rates of production with high quality offset duplicating equipment.

The system involves the provision of separate ink images on a blanket cylinder. In accordance with this practice, a master cylinder having inking means associated therewith is employed. The blanket cylinder then picks up the ink images from the master cylinder. Drive means rotate these cylinders and an associated impression cylinder in unison while copy sheets are fed between the blanket cylinder and impression cylinder.

First gripper means associated with the impression cylinder are adapted to successively engage the leading edge of each sheet, feed means for the copy sheets introducing one sheet for each revolution of the impression cylinder. The feeding of each sheet is synchronized with the first image on the blanket cylinder so that one side of each sheet receives the first image. Means are then provided for release of each sheet from the first gripper means, and for movement of each sheet to a sheet reversing area.

A second gripper means is adapted to grip the formerly trailing edge of each sheet as each sheet is re-fed from the reversing area. This operation takes place once during each revolution of the impression cylinder. Accordingly, the respective gripping means of the impression cylinder operator to accept separate sheets during each cylinder revolution. The second gripper, by gripping the formerly trailing edge of each sheet, and by moving in synchronism with the second image on the blanket cylinder, provides for transfer of that second image to the opposite side of each sheet.

Stripper means operate in conjunction with the impression cylinder so that sheets imaged on one side only can be delivered to the reversing area while duplexed sheets are delivered to a receiver area for collection. Each gripper means is designed to release the sheet edges after impression so that the stripper can effectively operate to remove the sheets. In this connection, the stripper can be readily employed for removing sheets imaged on one side only where this mode of operation is preferred.

DESCRIPTION OF THE PREFERRED EMBODIMENTS

Figure 1:
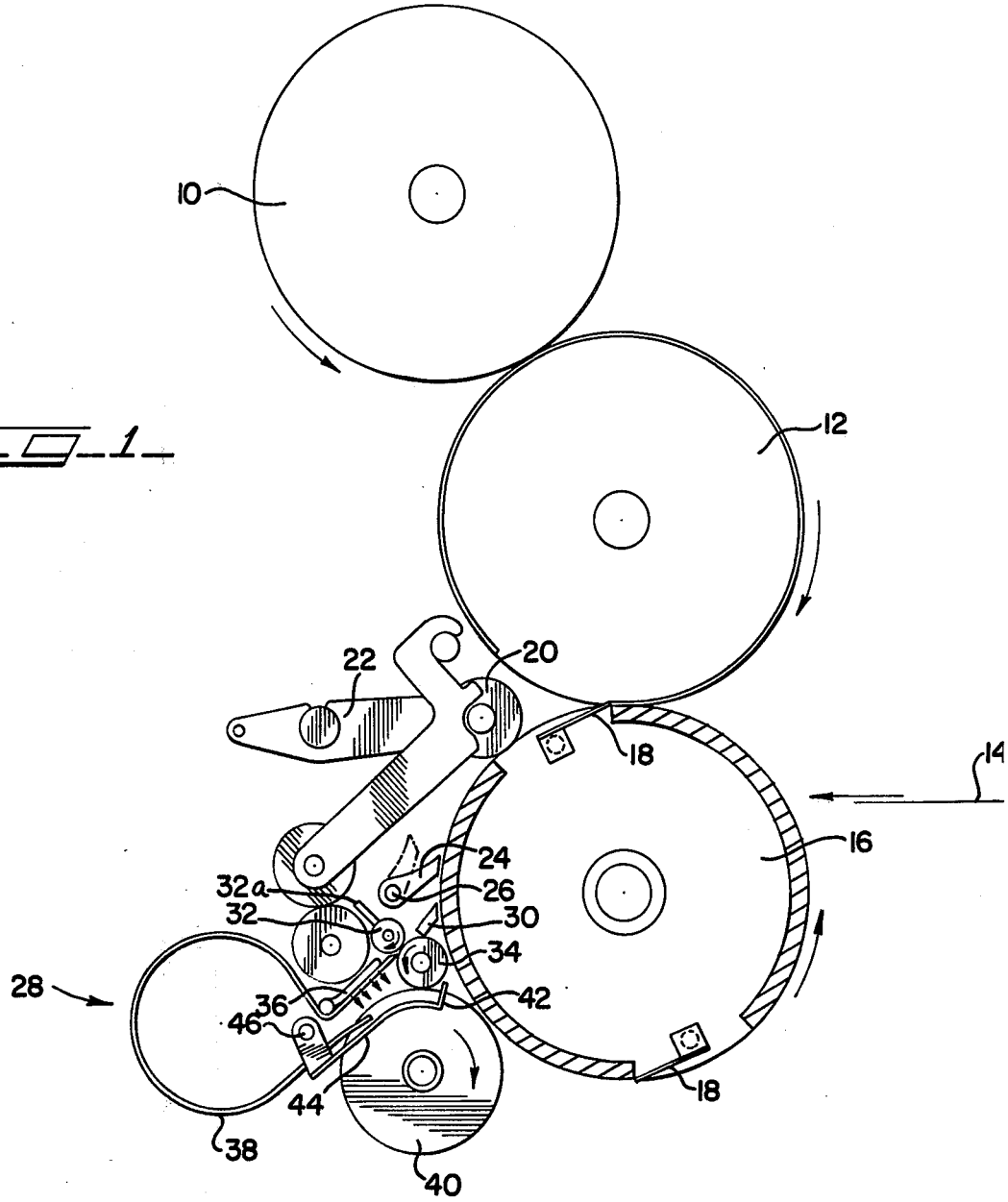
FIG. 1 is a schematic elevational view of offset duplicating equipment characterized by the features of this invention.

FIG. 1 of the drawings illustrates one suitable arrangement for accomplishing the objects of this invention. The structure illustrated comprises an offset duplicating arrangement wherein a master cylinder 10 is employed in association with a blanket cylinder 12. In accordance with this invention, the master cylinder is provided with first and second image plates or sheets or with a single plate or sheet defining first and second image areas. The masters are attached to the master cylinder in conventional fashion, and any suitable ink supply will be utilized in association therewith.

The blanket cylinder 12 is also of conventional design so that ink images will be transferred to the blanket cylinder. It will be apparent that these ink images will be in separate locations on the blanket cylinder.

The features of this invention are adaptable to cylinders of various sizes, depending upon the size of the copies desired. It is to be noted, however, that the invention does not require a variation from standard cylinder sizes in order to produce copies of conventional size. For example, standard size master cylinders will hold separate masters for producing images on $8\frac{1}{2}\times 11$ inch paper with the long axes of the masters being positioned parallel with the cylinder axis. The images on the blanket cylinders can be similarly oriented without difficulty, and $8\frac{1}{2}\times 11$ inch copy sheets are readily fed by conventional means with the side or long edges of the copy sheets comprising the leading and trailing edges during movement through the equipment.

Figure 2:
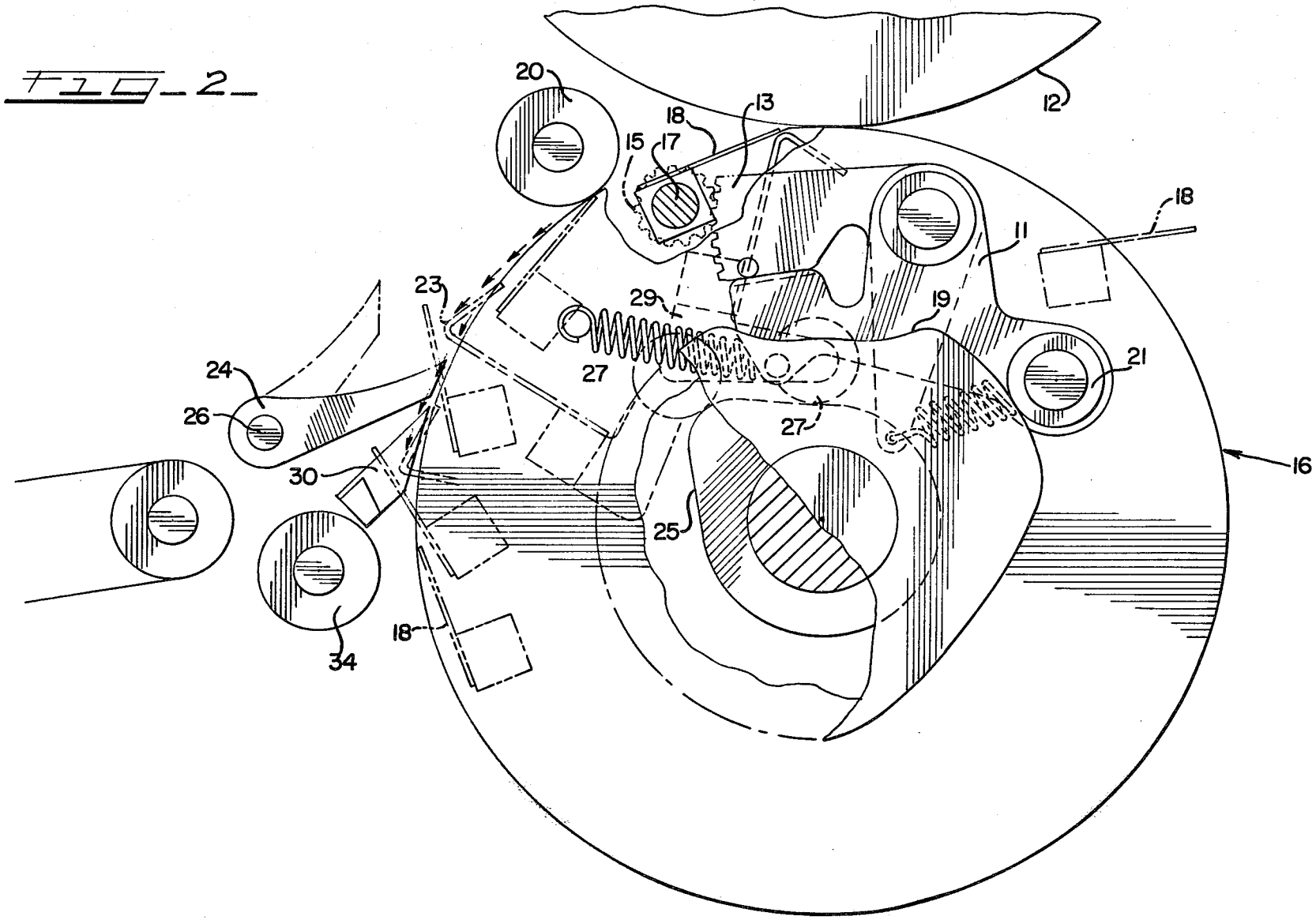
FIG. 2 is an enlarged detail view illustrating the sheet gripping and ejecting functions.

The copy sheets 14 are fed one at a time toward impression cylinder 16. In accordance with conventional practice, the impression cylinder grips the leading edge of the copy sheet, and thereby carries the copy sheet between the impression cylinder and blanket cylinder for transfer of ink images to the copy sheet. Suitable gripping means are available to those in the art, for example, paper grippers of the type employed in A. B. Dick offset duplicators, models 350–360. For purposes of this disclosure, it is sufficient to note that these grippers include pivotally mounted spring fingers 18 adapted to be pressed against copy sheet edges (FIG. 2). The pivoting movement of the fingers is controlled by fixed cam 19 and follower 21, the latter being mounted on lever assembly 11 having threaded end 13. This end engages gear 15 supported on the gripper shaft 17 with rotation of the shaft in response to the cam action causing opening of the fingers for receipt of a paper edge, closing of the fingers for gripping of the edge, and reopening of the fingers for release of the edge. Also in accordance with conventional practice, pushing or ejecting means 23 operate to separate the paper edge from the impression cylinder surface thereby facilitating separation of the paper from the surface. Such ejecting means, as in the above-identified structure, may be operated by a separate fixed cam 25 and follower 27 which act through lever 29.

The structure shown in FIG. 1 includes a pair of grippers having their pivot axes on opposite sides of the impression cylinder 16. Also associated with the impression cylinder is a roller assembly 20 which serves as a rotary chute for the copy sheets as they exit from between the impression cylinder and blanket cylinder. This roller assembly is conventionally provided so that the grippers can commence to open in this area of the operating cycle for commencement of separation of the copy sheets, the roller assembly providing a barrier against premature separation of the paper sheets from the impression cylinder. The roller assembly 20 is pivotally supported by arms 22, and the structure is designed with external rollers in the assembly engaging and riding on a ring surface of the impression cylinder 16 while internal rollers are spaced away from the impression cylinder to thereby define a rotary chute.

Figure 3:
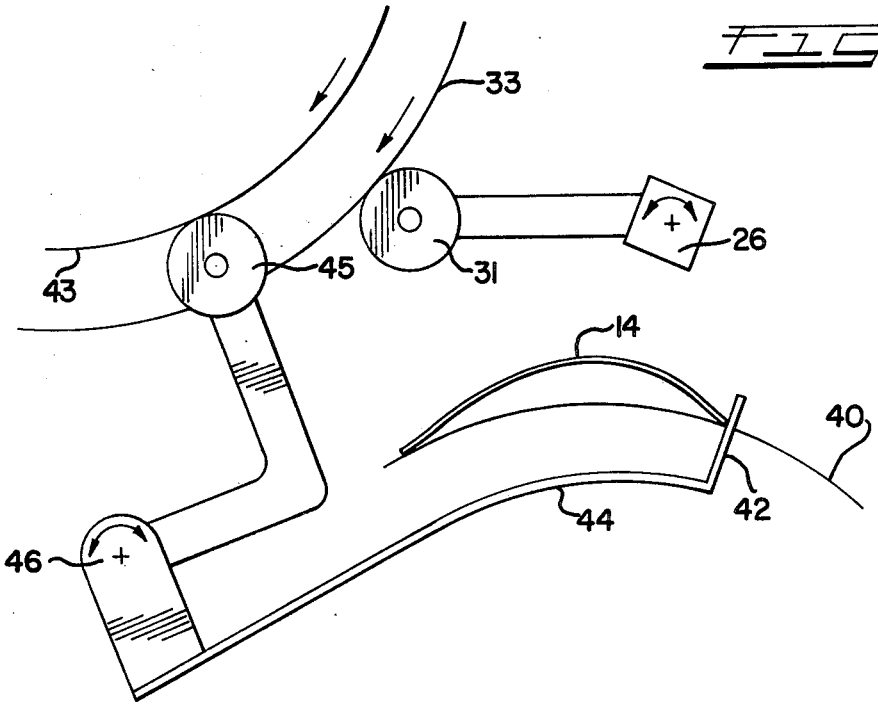
FIG. 3 is an enlarged detail view illustrating certain stripping and sheet stop functions.

A stripper arrangement is conventionally associated with such offset equipment for purposes of directing copy sheets to a receiving tray. In the embodiment illustrated, a plurality of stripper fingers 24 are mounted on shaft 26, and these fingers would be conventionally located in the dotted line position shown. In accordance with this invention, however, the shaft 26 is pivotally supported so that the stripper fingers can be pivoted out of a position where they engage with a copy sheet. This pivoting action is most simply controlled by follower 31 and cam means 33, the latter rotating in unison with the impression cylinder (FIG. 3).

Beyond the stripper fingers 24, this invention provides a copy sheet reversing station 28. This station first includes a fixed stripper blade or fixed stripper fingers 30 whereby all copy sheets passing beyond the pivotable strippers 24 will be fed to the nip of feed rollers 32 and 34. Immediately beyond the feed rollers, there is provided a duct 36 which defines openings whereby air streams are directed against the copy sheet exiting from between rollers 32 and 34. This serves to aid in directing the copy sheet to the interior of cylinder receptacle 38. The size of the receptacle is such that the entire copy sheet will be freely transmitted beyond the rollers 32 and 34. A felt wick **32*a* is provided for carrying etch solution to the surface of roller 32** for moistening the roller so that ink does not offset onto the roller from the freshly printed sheet.

An additional, larger feed roller 40 is provided for operation in association with said roller 34. As the trailing edge of each sheet exits from between the rollers 32 and 34, both the force of the air streams and the engagement of the sheet trailing edge with roller 34 brings the sheet toward the roller 40. As indicated by the illustrated direction of rotation, each sheet is thereby directed to the nip of rollers 34 and 40 for movement back toward the impression cylinder. The formerly trailing edge of each sheet thus becomes the leading edge during this reversing or re-feeding operation.

Stop members 42 are preferably interposed beyond the nip of the rollers 32 and 34 for engagement by the edge of the sheets. These stops are supported on arms 44 which are pivotally supported on a shaft 46. The roller 40 is formed by spaced-apart, disc sections to permit location of the stops within the roller periphery. The shaft 46 is preferably movable by cam means 43 and follower 45 (FIG. 3), so that the stops 42 will be moved out of blocking position relative to each sheet at appropriate intervals. The sheet 14 may be permitted to buckle against the stops 42 to provide positive registration of the sheet edge with the gripper when the stops are retracted.

Figure 4:
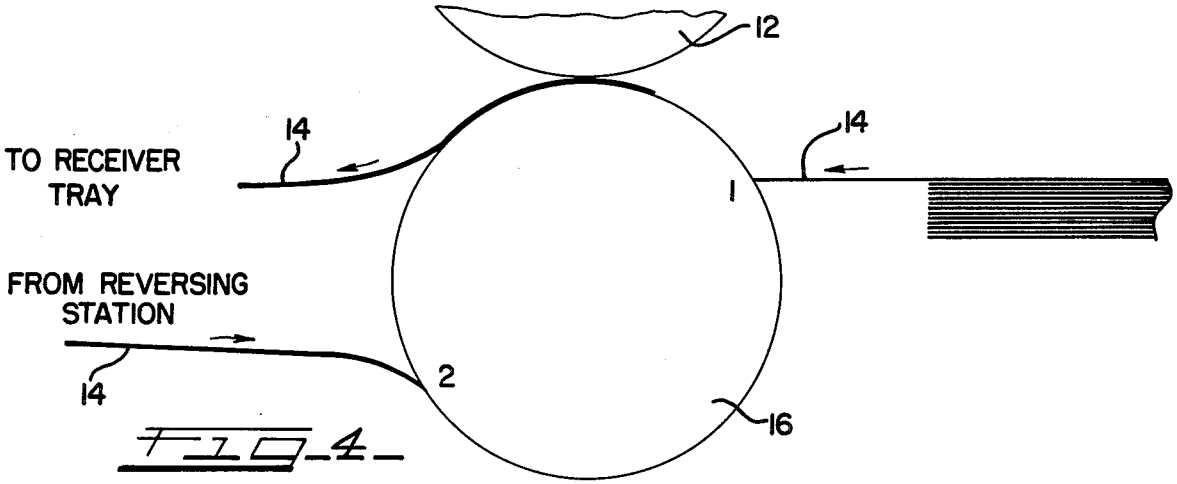
FIG. 4 is a diagrammatic view illustrating a stage of operation of the equipment during duplexing of copy sheets.
Figure 5:
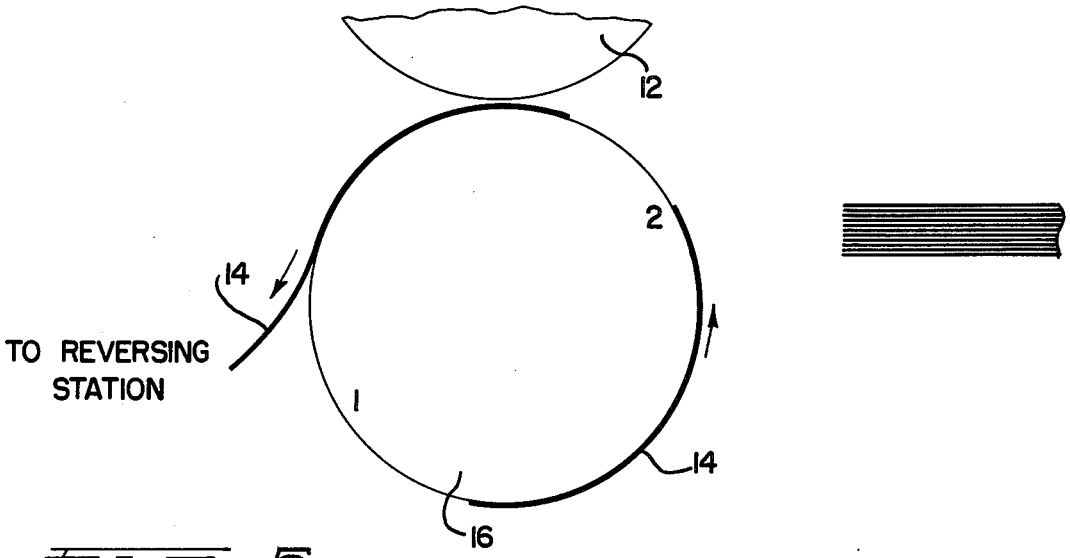
FIG. 5 is a diagrammatic view illustrating a different stage of operation.
Figure 7:
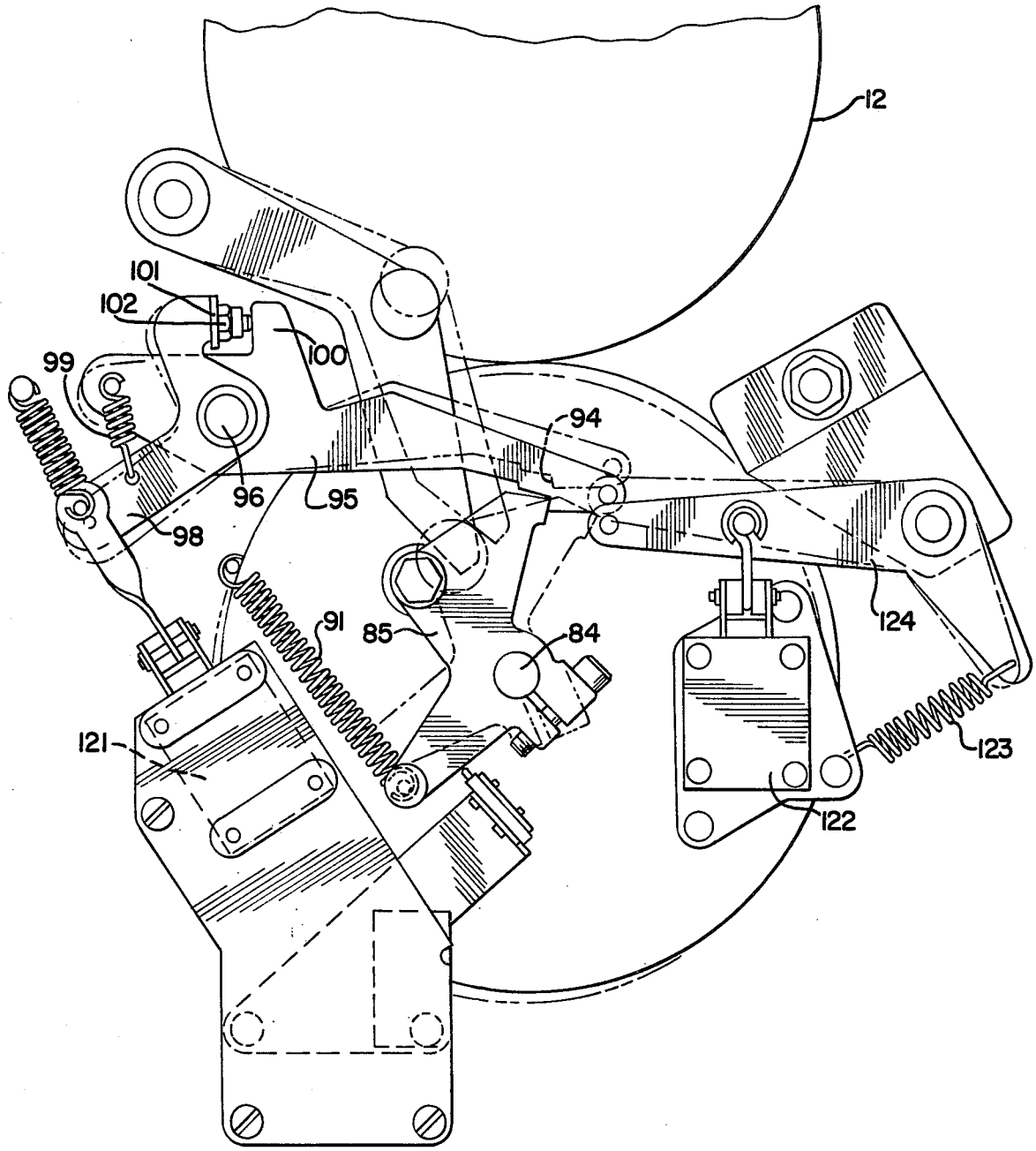
FIG. 7 is an elevational view illustrating cylinder separating mechanisms.
Figure 9A:
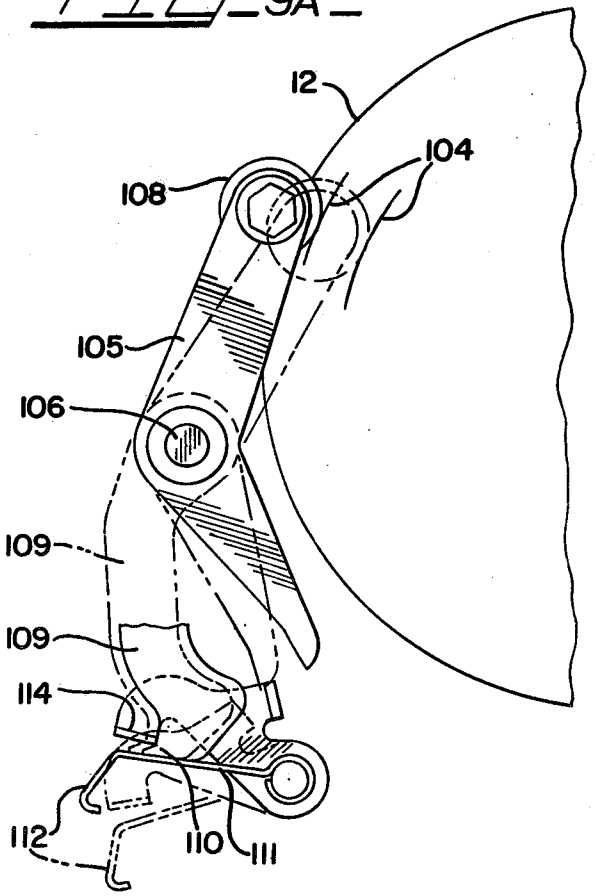
FIG. 9 is an elevational view also illustrating the cylinder separating mechanisms; and, FIG. 9*a* is a fragmentary view, partly cut away, illustrating a paper feeler structure employed for the separating mechanisms.
Figure 8:
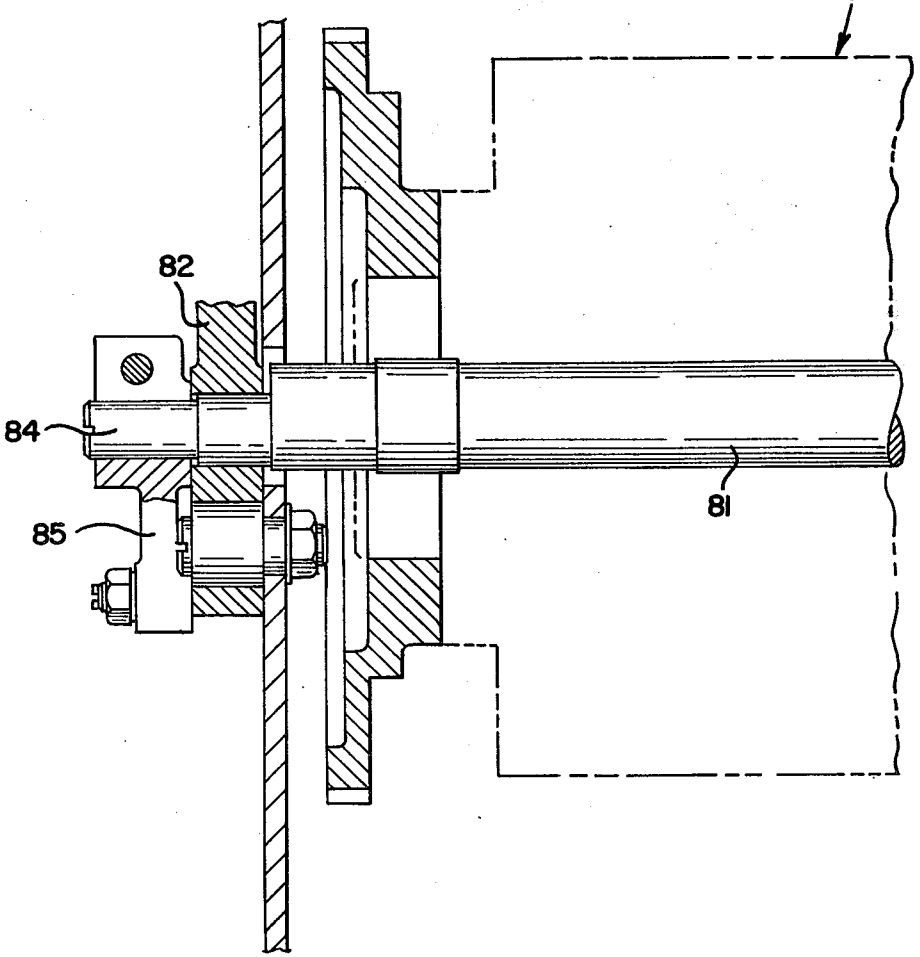
FIG. 8 is a fragmentary, cross-sectional view illustrating the cylinder separating structure in association with the impression cylinder shaft.
Figure 9:
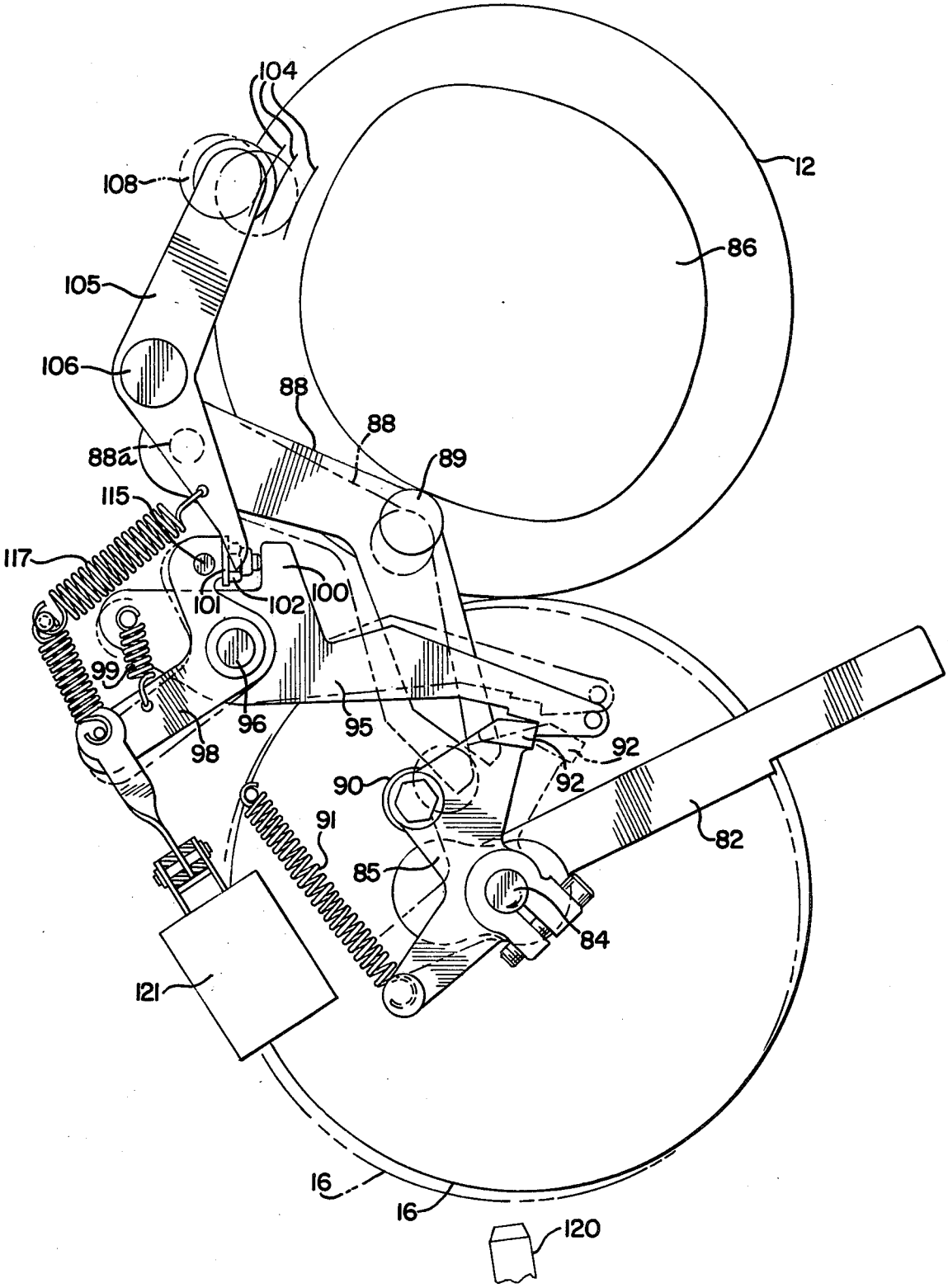

FIGS. 4 and 5 illustrate the stages of sheet movement which are accomplished with a construction as shown in FIG. 1. In these figures, the grippers 18 are identified by the numerals 1 and 2. In FIG. 4, the respective grippers are in position for receiving sheets while in FIG. 5, the grippers are shown after 180° of rotation.

A sheet 14 is first fed to gripper #1 as shown in FIG. 4. The sheet is then carried by gripper #1 through the nip of cylinder 12 and 16 for transfer of a first image on one side of the sheet. Thus, the apparatus is synchronized so that the first ink image will be in position for transfer from the blanket cylinder each time gripper #1 brings a copy sheet into position.

As already noted, and as diagramatically depicted in FIG. 5, gripper #1 releases the copy sheet while the first image is being transferred thereto, and in a duplexing operation, the strippers 24 are then held out of position so that the copy sheet 14 will engage fixed stripper 30 for movement to the reversing station.

After an additional 180° of movement of the impression cylinder, the same sheet 14 has completed the reversing action and the formerly trailing edge of the sheet has been driven into position for engagement by gripper #2 (see FIG. 4). Gripper #1 has, of course, now returned to a position for picking up the next copy sheet so that each gripper will then be carrying a sheet on the impression cylinder. Upon the next 180° of movement, the originally discussed sheet has been brought completely onto or wrapped about the impression cylinder by gripper #2 while the next sheet has received the first image on one side and is being directed into the reversing station (FIG. 5).

FIG. 4 shows the originally discussed sheet after the next 180° of movement, this sheet having been carried through the nip of the cylinders 12 and 16 for transfer of the second image on the opposite side of the sheet. Thus, the cylinder movements are synchronized so that the second image will always be in position for transfer when gripper #2 brings a copy sheet into position. Since gripper #2 only receives sheets from the reversing station, the side of the sheet receiving the second image will always be opposite the side receiving the first image.

As shown in FIG. 4, the sheet released by gripper #2 is directed to a receiver tray, this sheet now having been imaged on both sides. Since gripper #2 picks up a sheet during each revolution of the impression cylinder, it also discharges one sheet per revolution. Accordingly, the equipment produces copy at the rate of one sheet per revolution even though each copy has received images on both sides.

It will be noted that the sheets 14 occupy substantially the complete impression cylinder surface, less the portion occupied by the grippers. This is particularly significant when copy sheets of standard 8½ inch width are utilized since two sheets will readily fit on a standard 7 -inch diameter of cylinder surface when fed sidewise to the cylinder.

Figure 6:
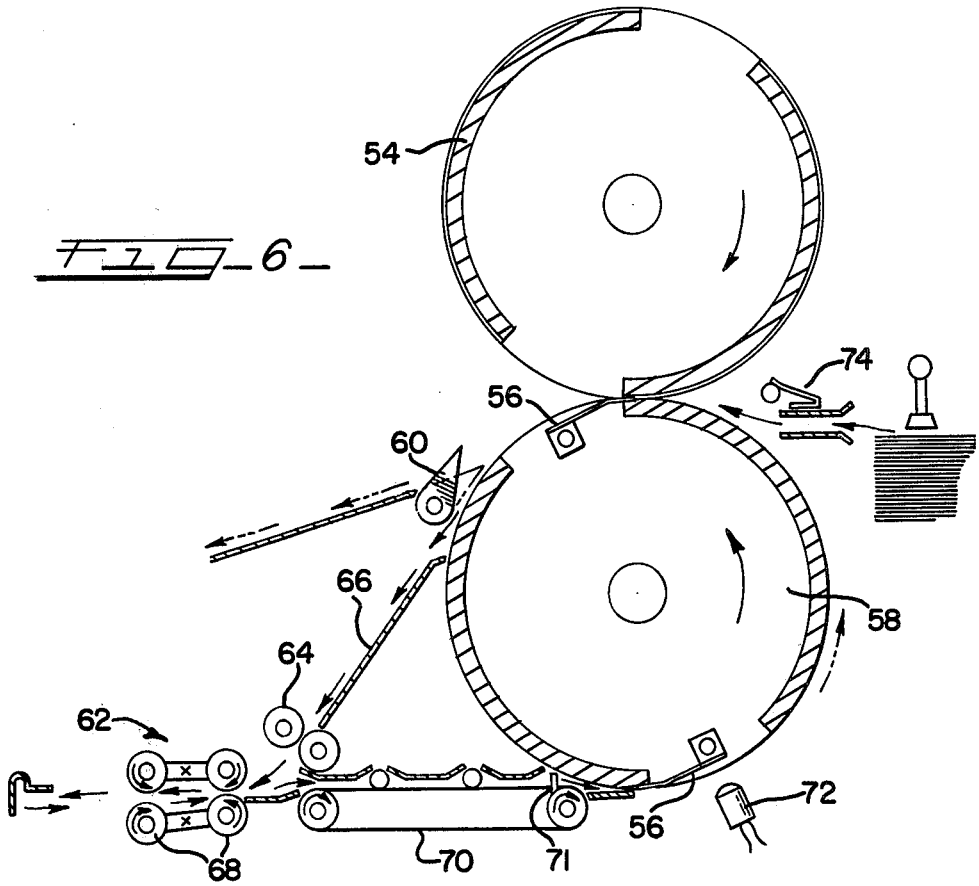
FIG. 6 is a schematic elevational view of an alternative arrangement for a duplexing system characterized by the features of this invention.

The arrangement of the invention shown in FIG. 6 also relates to offset duplicating systems. The blanket cylinder 54 carries first and second images, and a pair of grippers 56 deliver sheets to the nip of the blanket cylinder and impression cylinder 58 in synchronism with the separate images carried by the blanket cylinder. Similarly a pivoting stripper 60 delivers sheets to a receiver tray after duplexing of the sheets while pivoting out of position so that sheets imaged on one side only will be moved to reversing station 62.

The reversing station 62 consists of feed rollers 62 which receive each sheet directed along the fixed stripper ramp 66. Reversing rolls 68 are located in the reversing station so that once a sheet has been released by the drive rollers 64, the sheet may be directed to belt 70 for engagement by the second gripper 56 carried by the impression cylinder. The rollers 68 are of a type mounted on pivoting supports so that the lead pair will serve to draw a sheet into the station and then, after pivoting the lead pair out of contact, and the rear pair into contact, the latter will drive the sheets in the opposite direction.

The rotation of the blanket cylinder is synchronized with the movement of the second gripper means so that the second image on the blanket cylinder will be transferred to the opposite side of a copy sheet once during each revolution. The stripper 60 will then serve to deliver the duplexed copy sheet to a receiver tray.

The arrangement of FIG. 6 includes a paper sensing photocell 72 for purposes of detecting the presence of paper in association with the second gripper. A similar photocell to perform the same function can be incorporated in the embodiment of the present invention depicted in FIGS. 1–5. In the absence of paper, the photocell will signal for movement of the blanket cylinder away from the impression cylinder. In this fashion, the blanket cylinder will avoid contact with the bare surface of the impression cylinder which is highly undesirable in view of the problems encountered when ink is applied directly to an impression cylinder surface.

The mechanisms providing for the retraction of a blanket cylinder away from an impression cylinder are shown in FIGS. 7 through 9*a*. Specifically, these structures comprise standard impression cylinder separating mechanisms with supplemental control means so that the impression cylinder can be moved "off" impression during each half-revolution of operation rather than requiring a full revolution as in the standard operation. More particularly, added paper sensing and cylinder moving mechanisms are provided to insure that a bare impression cylinder surface and the inked blanket surface will not come into contact during either half revolution if no paper is fed from the main feed station or from the reversing station.

Referring to the drawings, the impression cylinder 16 is rotatably journalled on a shaft 81 which is mounted in a main support arm 82, the latter being pivotally connected to the frame of the apparatus. The support arm rotatably receives an offset stubshaft 84 which is integral with and extends from one end of the main shaft 81 so that when a crank lever 85 is rotated clockwise, the shaft 81 and the peripheral surface of the impression cylinder are moved away from the blanket cylinder located above the impression cylinder.

The rotational movement is selectively transmitted to the crank arm 85 by means of cam 86 located at one end of the blanket cylinder 12. The cam is formed with two lobes, each lobe having a profile matched to operations during a respective one of the half revolutions of the impression cylinder. In the exemplary embodiment, an arm 88 is pivotably supported at 88*a* and carries a follower 89 which is spring biased against the cam 86 and responds to the high and low points of the cam. As the cam 86 rotates, the lever 88 is moved between the two positions shown in FIG. 7, one in solid line and the other in broken line, corresponding to the follower riding the cam highs and lows.

The motion of the arm 88 is transmitted to the crank lever 85 through a follower 90 which is mounted on the crank lever 85. The crank lever 85 is spring biased in a clockwise direction by a spring 91 so that there is continually applied to the eccentric stubshaft 84 a turning force tending to separate the impression cylinder from the blanket cylinder to move the impression cylinder "off" impression. However, that turning force applied to the crank lever 85 is normally blocked by a dog 92 integrally formed in the crank arm 85 and locked in a cutout 94 of a lever 95. The cutout is fabricated with an acute angle (by one or two degrees) so the dog 92 engages with a locking action and the lever 95 cannot release until the dog 92 is retracted. Lever 95 is supported at a pivot point 96 and is coupled to a bell crank 98 by a spring 99. The bell crank 98 is also pivotable at 96.

The lever 95 and bell crank 98 comprise what is known as a "split-lever," that is, the two members 95 and 98 will work in unison. However, it is possible to move one of the levers, in this instance the bell crank 98, without moving the other lever and thereby apply a spring loading or urging force to the other lever, in this instance lever 95. The spring 99 applies a counterclockwise force to the lever 95 and a clockwise force to the bell crank 98 so that an ear 100 on lever 95 is urged towards a complementary ear 101 on bell crank 98. The respective ears 100, 101 are separated a preset distance apart by an adjustable lock nut assembly 102.

A paper feeler cam 104 comprises part of the blanket cylinder mechanism. This cam is provided with one lobe related to the timing of paper transport or entry into the impression cylinder. It determines if paper is actually entering and uses that information to select the impression cylinder status, i.e., "on" or "off" impression. If the machine has been in operation and the cylinder has been "on" impression, the blanket cylinder and impression cylinder would be separated if it is sensed that no additional sheets are entering the machine.

The paper sensing subassembly includes a lever 105 mounted on a shaft 106 and having a follower 108 which rides on the cam surface 104. The shaft 106 extends across the width of the machine and has at its other end a depending feeler arm 109. The latter has at its lower extremity a foot 110 which is adapted to catch a paper sensing feeler arm 111. The latter is operative to stop the movement of the arm 109 and therewith the connected members including the arm 105 so that the follower 108 is prevented from riding over the full excursion of the cam, specifically down to the cam low point. The arm 111 engages the foot 110 and prevents the follower 108 from riding into the low of the cam lobe when entry of a sheet of paper is sensed.

The paper sensor arm 111 includes a depending feeler finger 112 that is cyclically operated, for example by a cam (not shown) so as to test for paper. The finger 112 is free to drop through the paper path when no paper is present. The consequence is that the arm 111 pivots so that an integral catch 114 can no longer engage the foot 110 of lever 109. As a result of the "no paper present" signal, the arm 109 is free to swing in a clockwise direction. Accordingly, the follower 108 rides down into the low of cam lobe 104. Clockwise spring force is then applied by spring 117 to the lever 105 to apply a force against a pin 115 on the bell crank 98 thereby transmitting counterclockwise motion to the bell crank 98. As will be appreciated from the description of the split lever operation of lever 95 and bell crank 98, that movement of bell crank 98 stretches spring 99 and applies a counterclockwise urging force to the lever 95.

As described above, the lever 95 includes the cutout 94 which has a locking angle engagement with dog 92 in order to prevent the arm 95 from lifting or rotating counterclockwise when the spring 99 applies the aforedescribed urging force. The lever 95 will not lift until the crank arm 85 and dog 92 are backed away from the notch or cutout 94.

The crank arm 85 is backed away from the notch 94 twice during each cycle of the impression cylinder, which cycling of the crank arm is controlled by the profile of the two lobe cam 86 and the operation of the follower arm 88 as described above. Thus, if a spring urging force is acting on the arm 95 because paper is no longer being fed into the machine, the lever 95 will swing up and permit the crank arm dog 92 to release or swing by and the crank arm 85 to rotate in a clockwise direction. That rotation occurs because the follower 90 moves in response to arm 88 pivoting in a counterclockwise direction as its follower 89 traces the profile of the cam 86. The clockwise movement of the crank arm 85 applies a turning force to the stubshaft 84. Since the main impression cylinder shaft 81 is eccentrically supported relative to stubshaft 84 as already described, the rotary motion of the latter is transmitted as downward movement of the impression cylinder away from the blanket cylinder.

In accordance with the present invention, an additional sensing means, a solenoid assembly, and the additional lobe on the cam 16 are provided to achieve "off" impression when there is no paper feed to either of the gripping means. The additional sensing means comprise a photocell 120 employed to monitor the actual presence of paper on the impression cylinder after it has been fed from the reversing station onto the cylinder. The photocell has a predetermined, cyclic operating period, and if the photocell senses the absence of paper on the impression cylinder during its operative time period, it will activate appropriate electrical circuitry to energize a solenoid 121. Energization of the latter applies a counterclockwise rotation to bell crank 98. The effect of that is to stretch spring 99 and, as has been described above, to apply an urging force to the lever 95 so it will lift when released by the retraction of crank arm dog 92 in response to one of the lobes on cam 86. Crank arm 85 can then rotate in a clockwise direction and move the impression cylinder "off" impression.

The other solenoid 122 is conventionally used to cause cylinder separation when the power if off. Thus, the solenoid is de-energized when power is off and spring 123 then pivots crank arm 124 to release dog 92.

It will be apparent that the mechanisms described provide means for duplexing copy sheets without the necessity for substantial changes in equipment size and operating characteristics. With the provision of means for maintaining the pivoting strippers in the operating position, the construction also provides for the formation of copies imaged on one side in the usual fashion.

This can be accomplished by a machine operator by means of a simple control so that versatility in the system is achieved in a highly efficient manner.

As previously noted, the construction described is suitable for the production of copies imaged on one side only. This can be readily accomplished by utilizing the standard feed mechanisms for feeding sheets to the impression cylinder in synchronism with images on the blanket cylinder. The stripper mechanism is then maintained in position for removing each sheet after a single pass between these cylinders.

Single side images can also be readily produced by providing a separate conventional feed mechanism for each gripper. Thus, referring to FIG. 4, sheets fed to gripper #2 could be from a stack of blank sheets, and each of these sheets will be imaged by the second ink image on the blanket cylinder. Again, the stripper is simply set to discharge each sheet to the receiver tray.

The first and second ink images on the blanket cylinder may, under these circumstances, be identical images so that each sheet produced will be identical. It will then be appreciated that the construction is capable of producing two copies for each revolution of a cylinder, and significantly improved production rates are obtainable.

As indicated, the invention is applicable to other than offset duplicating systems. For example, the paper handling features could be associated with a cylinder in a xerographic system in place of an impression cylinder, and where a selenium drum would be utilized instead of a blanket cylinder. In such a system, toner particles would be used instead of a wet ink. Furthermore, the invention is applicable to direct lithography systems and to offset systems not having an intermediate blanket cylinder.

In the appended claims, it will be understood that the references to grippers include those other than of the strictly mechanical type, for example, grippers relying on electrostatic attraction or vacuum force to hold sheets on a cylinder. Furthermore, the reference to a cylinder in this description is not limiting since a carrier for the grippers of non-cylindrical cross-section is contemplated.

It will be understood that other changes and modifications may be made in the above described systems which provide the characteristics of this invention without departing from the spirit thereof particularly as defined in the following claims.

That which is claimed is:

1. In a duplicating system for duplicating images on both sides of copy sheets including a surface for carrying first and second images transferable to the copy sheets, a carrier, drive means for moving said surface and carrier in unison, means for feeding the copy sheets between the surface and the carrier, gripper means associated with the carrier for gripping edges of said sheets and for holding the sheets on the carrier, said gripper means comprising first and second grippers for separately holding sheets on the carrier, said feeding means feeding each sheet to the first gripper whereby the leading edge of each sheet is engaged by the first gripper and each sheet is moved between the image carrying surface and carrier, said feeding being synchronized with the movement of the first image on the image carrying surface for transfer of said first image to one side of each sheet, and means for releasing said sheet from said first gripper, the improvement in means for handling said sheets after release and for re-feeding said sheets to said second gripper, said handling and re-feeding means comprising fixed stripper means positioned adjacent said carrier, sheet drive means positioned beyond said stripper means, a sheet reversing station, said sheet drive means directing each sheet to said reversing station, said reversing station including second sheet drive means movable in a direction opposite said first mentioned sheet drive means for re-feeding the sheets to said carrier, said second gripper engaging the formerly trailing edge of said sheets opposite the edge held by said first gripper, said sheets being re-fed to said second gripper in synchronism with the second image on said image bearing surface for duplication of said second image on the opposite side of each sheet, and means for releasing said sheets from said second gripper for delivery of the sheets to a receiving area.

2. A duplicator in accordance with claim 1 wherein one sheet is engaged by said first gripper while a second sheet is simultaneously engaged by said second gripper.

3. A duplicator in accordance with claim 2 wherein said one sheet and said second sheet are dimensioned to cover substantially the complete surface area of said carrier, less the surface area occupied by said grippers.

4. A duplicator in accordance with claim 3 wherein said carrier comprises a cylinder, said first and second grippers being positioned approximately 180° apart on said carrier.

5. A duplicator in accordance with claim 1 wherein said first and second grippers each engage one sheet during each revolution of said carrier, and wherein one sheet imaged on both sides is removed from said carrier during each revolution of the carrier.

6. A duplicator in accordance with claim 1 including movable stripper means for removing said sheets from the carrier, and means pivotally supporting the movable stripper means for selectively positioning the movable stripper means whereby the movable stripper means are movable out of operating position to permit passage of sheets imaged on one side only, and are movable into operating position for removal of sheets after completion of imaging.

7. A duplicator in accordance with claim 6 wherein said movable stripper means are maintainable in operating position for removing a sheet after imaging on one side only.

8. A construction in accordance with claim 1 including stop members interposed in the path of movement of sheets re-fed to said carrier, said stop members being adapted to engage said trailing edges of said sheets after commencing of said re-feeding movement, and means for removing said stop members from the path of movement of said sheets when said second gripper is positioned for receiving a sheet.

9. A construction in accordance with claim 8 including drive means for said stop members, said drive means including camming means for imparting reciprocating movement to the stop members.

10. A construction in accordance with claim 8 wherein said trailing edges engage said stop members prior to movement of said second gripper into position for receiving the sheets whereby movement of sheets operates to develop a bend in the sheets, and whereby removal of sheets operates to thrust the trailing edges of sheets forwardly toward said second gripper for positive registry of the trailing edges with the second gripper.

11. In a method for duplicating images on copy sheets wherein the images are formed on a surface and transferred from the surface to copy sheets positioned on a moving carrier, the carrier including first and second grippers for holding the copy sheets thereon, and first and second ink images formed on said surface, said method involving feeding of said sheets to a first gripper on the carrier for movement of the sheets between said surface and said carrier with one edge of the sheets forming the leading edge, releasing of each sheet from the first gripper, reversing the direction of movement of the sheets whereby each sheet is re-directed to a second gripper on the carrier for movement between said surface and carrier with the opposite edge of the sheets forming the leading edge, and synchronizing of the respective sheet feeding operations whereby each sheet receives said first image on one side thereof when first passed between said surface and carrier, and each sheet receives said second image on the opposite side thereof when re-fed between said surface and carrier, the improvement comprising the step of providing a fixed stripper for directing the sheets away from the carrier, providing drive rollers for removing the sheets from the carrier, and thereafter engaging the sheets with oppositely driven rollers for return movement to the carrier.

12. A method in accordance with claim 11 wherein one sheet is fed to said first gripper substantially simultaneously with the feeding of a second sheet to said second gripper.

13. A method in accordance with claim 11 wherein said copy sheets have a length exceeding their widths, and wherein said copy sheets are fed sidewise to said grippers whereby the long edges of the copy sheets comprise the edges engaged by said grippers.

14. A method in accordance with claim 11 wherein stripper means are provided for removing said copy sheets from the surface of said carrier, and including the step of moving said stripper means into operating position for removing a copy sheet for transmittal to a receiver area after formation of said second image on the copy sheet, and moving said stripper means out of operating position to permit said copy sheets to by-pass the stripper means when only said first image is formed on said copy sheets.

* * * * *